US007575482B1

(12) United States Patent
Pepe et al.

(10) Patent No.: US 7,575,482 B1
(45) Date of Patent: Aug. 18, 2009

(54) ELECTRICAL CONNECTOR WITH ENHANCED BACK END DESIGN

(75) Inventors: Paul John Pepe, Clemmons, NC (US); Shawn Phillip Tobey, Trinity, NC (US); Sheldon Easton Muir, Whitsett, NC (US); Steven Richard Bopp, Jamestown, NC (US); James Shannon Hower, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/107,228

(22) Filed: Apr. 22, 2008

(51) Int. Cl.
*H01R 24/00* (2006.01)

(52) U.S. Cl. ..... 439/676; 439/608; 439/941

(58) Field of Classification Search ..... 439/676, 439/608, 610, 941, 417
See application file for complete search history.

(56) References Cited

U.S. PATENT DOCUMENTS

| | | | | |
|---|---|---|---|---|
| 6,077,122 | A * | 6/2000 | Elkhatib et al. | 439/608 |
| 6,129,586 | A | 10/2000 | Bellemon | |
| 6,346,005 | B1 * | 2/2002 | Viklund et al. | 439/404 |
| 6,758,695 | B2 | 7/2004 | Pepe et al. | |
| 2005/0106946 | A1 * | 5/2005 | Doorhy et al. | 439/676 |

* cited by examiner

*Primary Examiner*—Ross N Gushi

(57) ABSTRACT

An electrical connector includes a back end sub-assembly including a back end housing extending along a longitudinal axis between a forward side and a rearward side. The back end housing defining a plurality of contact zones. At least one contact is held in each of the plurality of contact zones. A shield is provided within each of the plurality of contact zones with each shield at least partially surrounding at least one contact in the corresponding contact zone. Each shield is non-common with and does not electrically engage any other shield in the back end housing.

20 Claims, 12 Drawing Sheets

ELECTRICAL CONNECTOR WITH ENHANCED BACK END DESIGN

BACKGROUND OF THE INVENTION

The subject matter herein relates generally to electrical connectors, and more particularly, to a connector jack having a standard plug interface combined with a back end design for improved connector performance.

In electrical systems, such as telecommunications systems, there is increasing concern for preserving signal integrity as signal speed and bandwidth increase. One source of signal degradation is crosstalk between multiple signal paths. In the case of an electrical connector carrying multiple signals, crosstalk occurs when signals conducted over a first signal path are partly transferred by inductive or capacitive coupling into a second signal path. The transferred signals produce crosstalk in the second path that degrades the signal routed over the second path.

One example of a typical connector for telecommunications systems is the industry standard type RJ-45 communication connector. Both plugs and jacks are provided for mating with one another. The RJ-45 connector includes four pairs of conductors that define four different signal paths for carrying differential signals. The plugs are dictated by industry standards and are inherently susceptible to crosstalk, return loss and other phenomenon that lead to signal degradation. The jacks are designed to mate with the plugs, and as such have a conventionally designed front end for mating with the RJ-45 plug. Various features have been used in conventional RJ-45 jacks to compensate for the inherent electrical performance problems of the RJ-45 plugs. Typically, the compensation is provided at the front end, such as by controlling the positioning of mating contacts of the jacks. Additionally, at least some known jacks include compensation components that are utilized to tune or otherwise control certain electrical characteristics of the jacks. However, heretofore, little attention has been paid to the rear end of the jacks where the jacks are connected to cables.

The design of the jacks and cables are susceptible to crosstalk even at the rear end of the jack. Problems associated with the design of the jacks and the cables are becoming more prevalent with the increase in signal speed and bandwidth. At least some known jacks have provided shielding at the rear end of the jack between the signal pairs. For example, some known jacks utilize a plus-shaped shield at the rear end to separate each signal pair. However, with such designs noise coupling in one region of the jack is propagated to other areas of the jack. The shortcomings that are inherent in jacks such as the RJ-45 can be expected to become more serious as system demands continue to increase.

It would be desirable to provide a connector that is designed to provide improved high speed performance by minimizing crosstalk and optimizing return loss while providing a standardized plug interface.

BRIEF DESCRIPTION OF THE INVENTION

In one embodiment, an electrical connector is provided. The electrical connector includes a back end sub-assembly including a back end housing extending along a longitudinal axis between a forward side and a rearward side. The back end housing defining a plurality of contact zones. At least one contact is held in each of the plurality of contact zones. A shield is provided within each of the plurality of contact zones with each shield at least partially surrounding at least one contact in the corresponding contact zone. Each shield is non-common with and does not electrically engage any other shield in the back end housing.

Optionally, each contact zone may include a single pair of contacts carrying differential signals. Each shield may be arranged at least partially between the associated contact zone and at least two other contact zones. Each contact zone may include more than two contacts. Optionally, the back end housing may be arranged in quadrants with each quadrant containing a single contact zone. Each shield being arranged between at least two adjacent quadrants. Each contact zone may be separated from each other contact zone by at least two shields. Each shield may be separated from each other shield by a dielectric barrier. The back end housing may include a plurality of shield channels with each shield being received in a corresponding shield channel. Each shield may be securely held by the back end housing.

In another embodiment, an electrical connector is provided that includes a housing having a forward mating end and an opposite rearward cable receiving end and a back end sub-assembly held in the housing proximate the cable receiving end. The back end sub-assembly includes a back end housing extending along a longitudinal axis between a forward side and a rearward side, and the back end housing defines a plurality of contact zones. A pair of contacts is held in each contact zone. A shield is held in each contact zone, wherein the shield is positioned between the contacts in the corresponding contact zone and at least one contact in at least one other contact zone. Each shield is a floating shield that does not electrically engage any other shield in the back end housing.

In a further embodiment, an electrical connector is provided that includes a housing having a forward mating end and an opposite rearward cable receiving end, and a back end sub-assembly held in the housing proximate the cable receiving end. The back end sub-assembly includes a back end housing holding back end contacts and a shield positioned between selected ones of the back end contacts. The back end housing extends along a longitudinal axis between a forward side and a rearward side, and the back end housing includes an alignment member extending toward the cable receiving end of the housing. A lacing cap is attached to the cable receiving end of the housing. The lacing cap is configured to receive a multi-wire cable and includes lacing stations configured for holding the individual wires of the multi-wire cable to terminate to the back end contacts. The lacing cap includes an alignment slot that receives the alignment member to align the lacing stations with the back end contacts.

DETAILED DESCRIPTION OF THE INVENTION

Figure 1:
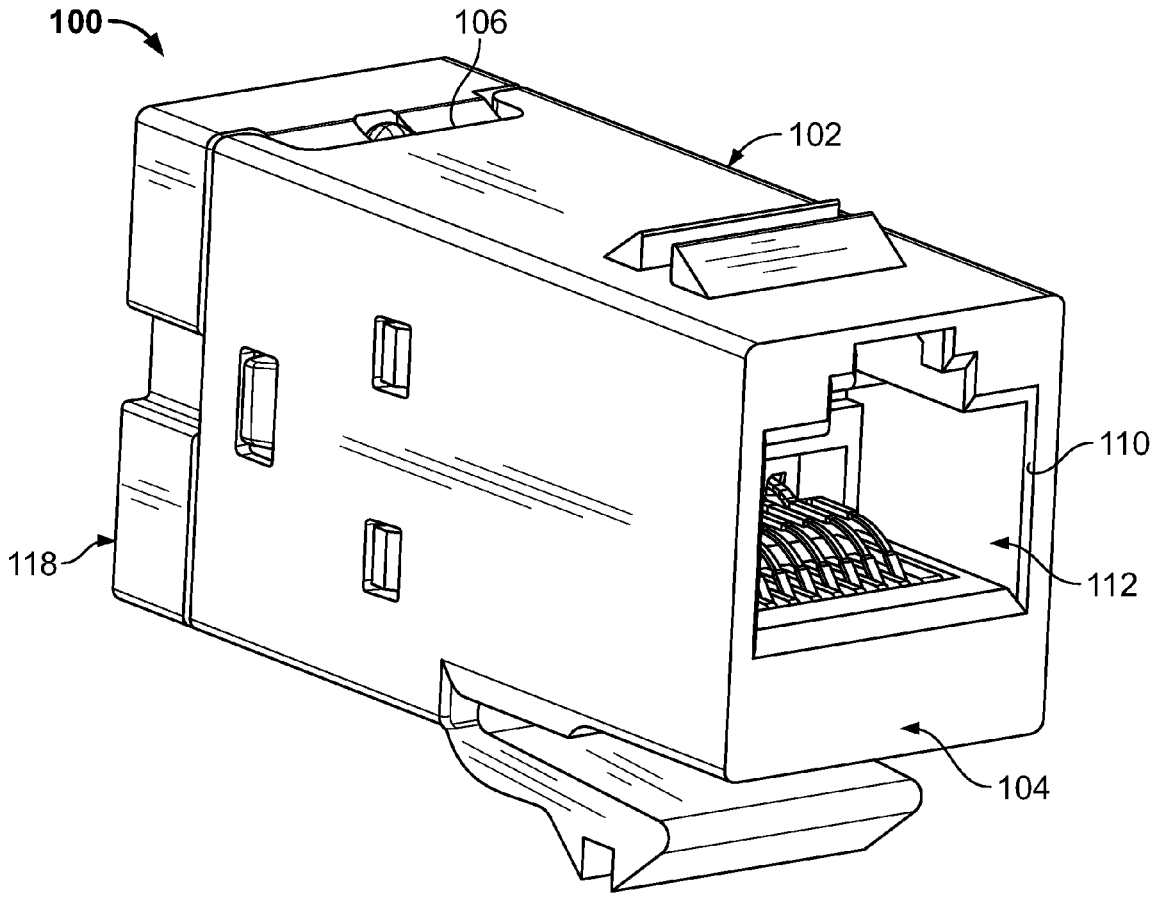
FIG. 1 is a perspective view of an electrical connector formed in accordance with an exemplary embodiment.

FIG. 1 is a perspective view of an electrical connector 100 formed in accordance with an exemplary embodiment. The connector 100, in an exemplary embodiment, is a modular jack that may be mounted on a wall or panel (not shown), or, alternatively, may be mounted in an electrical device or apparatus (not shown) having a communications port through which the device may communicate with other external networked devices. In the description that follows, the connector 100 will be described in terms of an RJ-45 jack. However, it is to be understood that the benefits described herein are also applicable to other connectors in alternative embodiments, including connectors including fewer or greater numbers of signal pairs. The following description is therefore provided for illustrative purposes only and is but one potential application of the subject matter described herein.

The connector 100 includes a housing 102 that has a forward mating end 104 and an opposite rearward cable receiving end 106 that may also be referred to as a back end. The mating end 104 includes an opening 110 that opens to a mating interface 112 that is configured to receive a mating plug (not shown). A lacing cap 118 is attached to the rearward end 106 of the housing 102.

Figure 2:
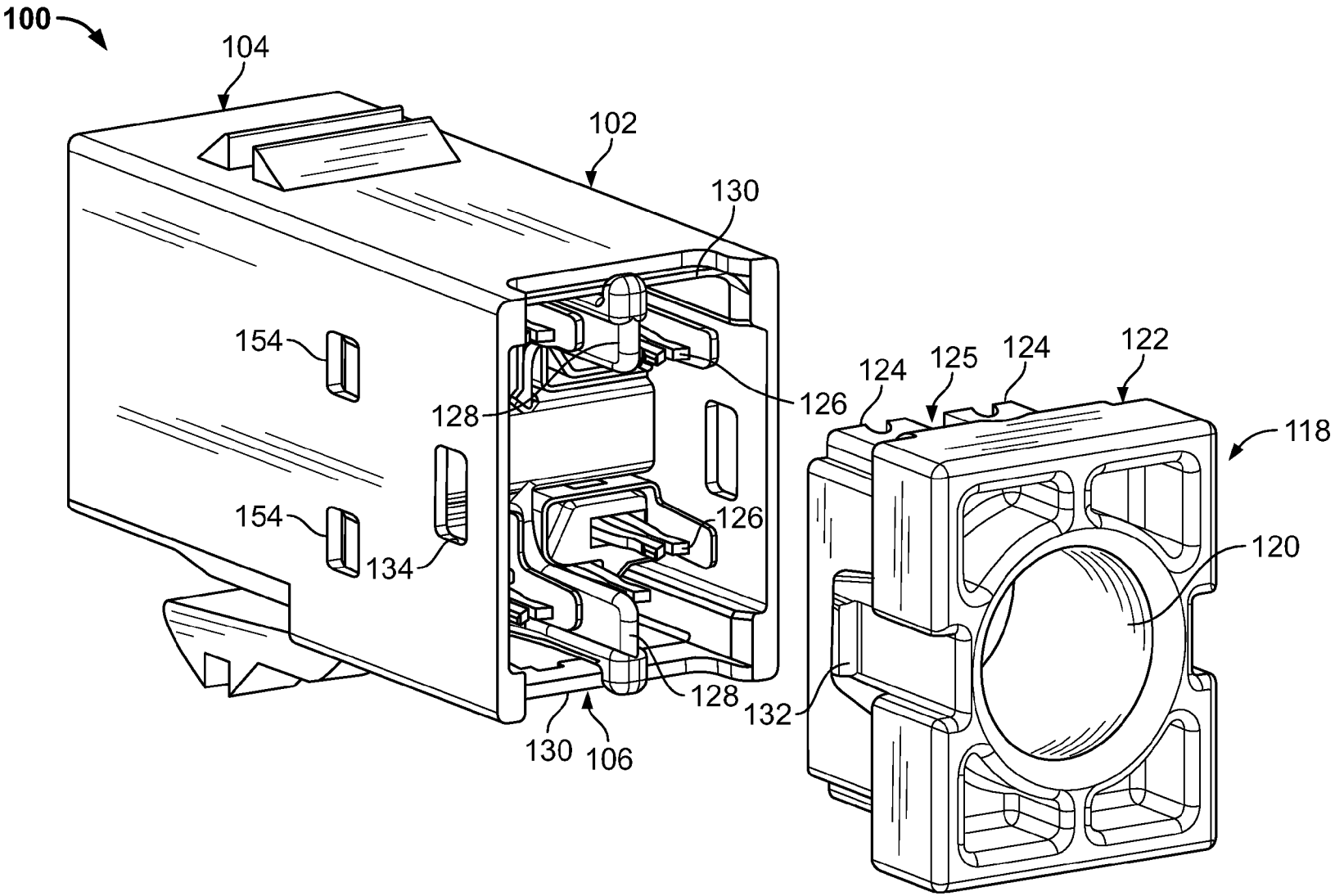
FIG. 2 is a perspective view of the connector shown in FIG. 1 taken from the cable receiving end.

FIG. 2 is a perspective view of the connector 100 taken from the cable receiving end or back end 106. In FIG. 2, the lacing cap 118 is shown separated from the housing 102. The lacing cap 118 includes an opening 120 that receives a multi-wire cable (not shown). In the case of an RJ-45 connector, the cable includes eight individual wires. The lacing cap 118 includes an inner side 122 upon which lacing stations 124 are formed. Alignment slots 125, only one of which is visible in FIG. 2, are formed between the lacing stations 124. One or more alignment members 128 are provided in the interior of the connector 100 and are configured to be received in the alignment slots 125 to orient the lacing cap 118 with respect to the remainder of the connector 100 and to the housing 102 during assembly. When the lacing cap 118 is installed on the housing 102, the individual cable wires (not shown) are laced within or along respective lacing stations 124. Suring assembly, the lacing cap 118 is coupled to the housing 102 and the individual wires positioned by the lacing stations 124 are connected to respective back end contacts 126 in the connector 100. In an exemplary embodiment, the back end contacts 126 may be insulation displacement contacts ("IDC contacts"). However, other types of contacts may be utilized in alternative embodiments. Cutting blades 130 may be provided in the housing 102 for trimming excess lengths of the wires (not shown) when the lacing cap 118 is coupled to the housing 102. The lacing cap 118 includes latch elements 132 that are received in latch receptacles 134 in the housing 102 to retain the lacing cap 118 on the housing 102. When installed on the housing 102, the lacing cap 118 also provides a strain relief for the cable (not shown) according to known methods.

Figure 3:
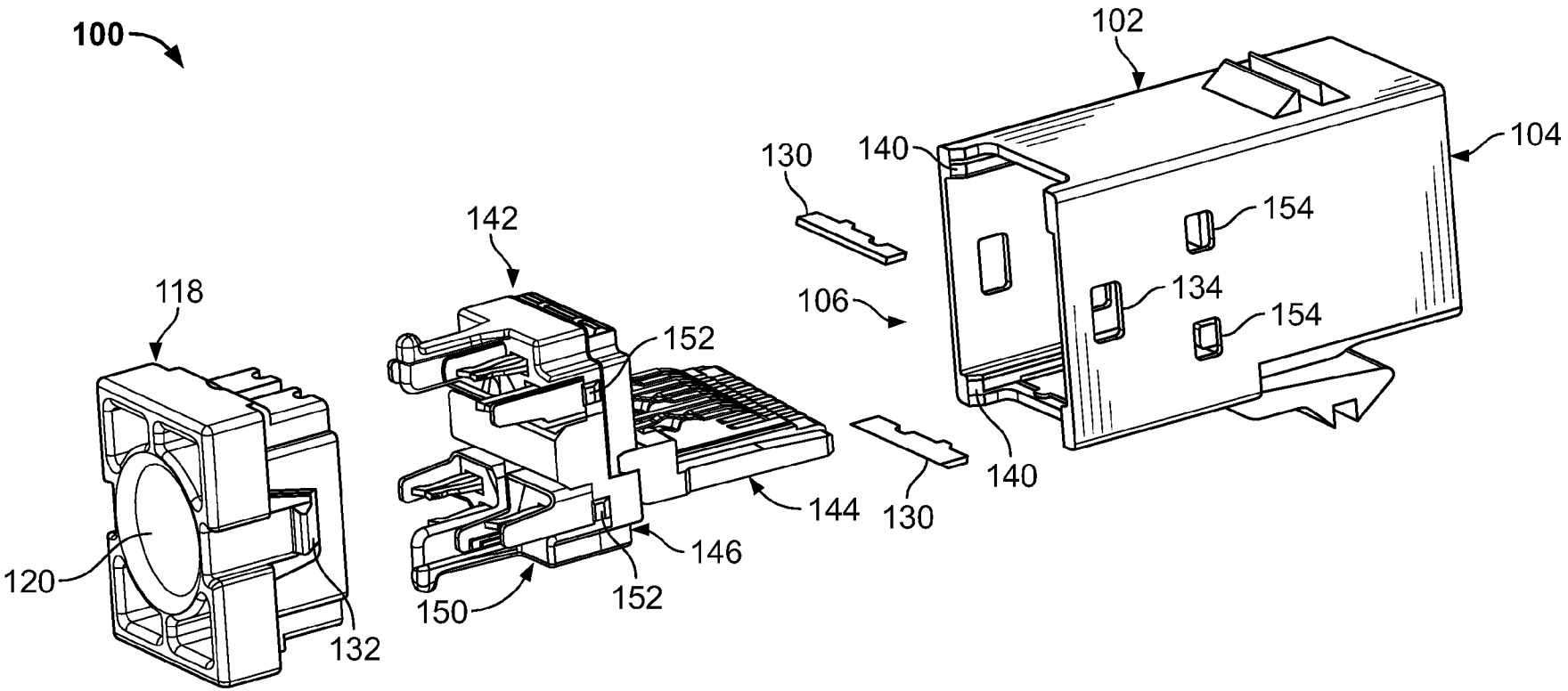
FIG. 3 is a partially exploded view of the connector shown in FIG. 1.

FIG. 3 is a partially exploded view of the connector 100. The housing 102 includes slots 140 that receive the cutting blades 130. The housing 102 receives a connector sub-assembly 142 that includes an array housing assembly 144, a circuit board 146 and a back end sub-assembly 150. The back end sub-assembly 150 includes latch elements 152 (best shown in FIG. 4) that are received in latch receptacles 154 in the housing 102 to retain the connector sub-assembly 142 in the housing 102.

Figure 4:
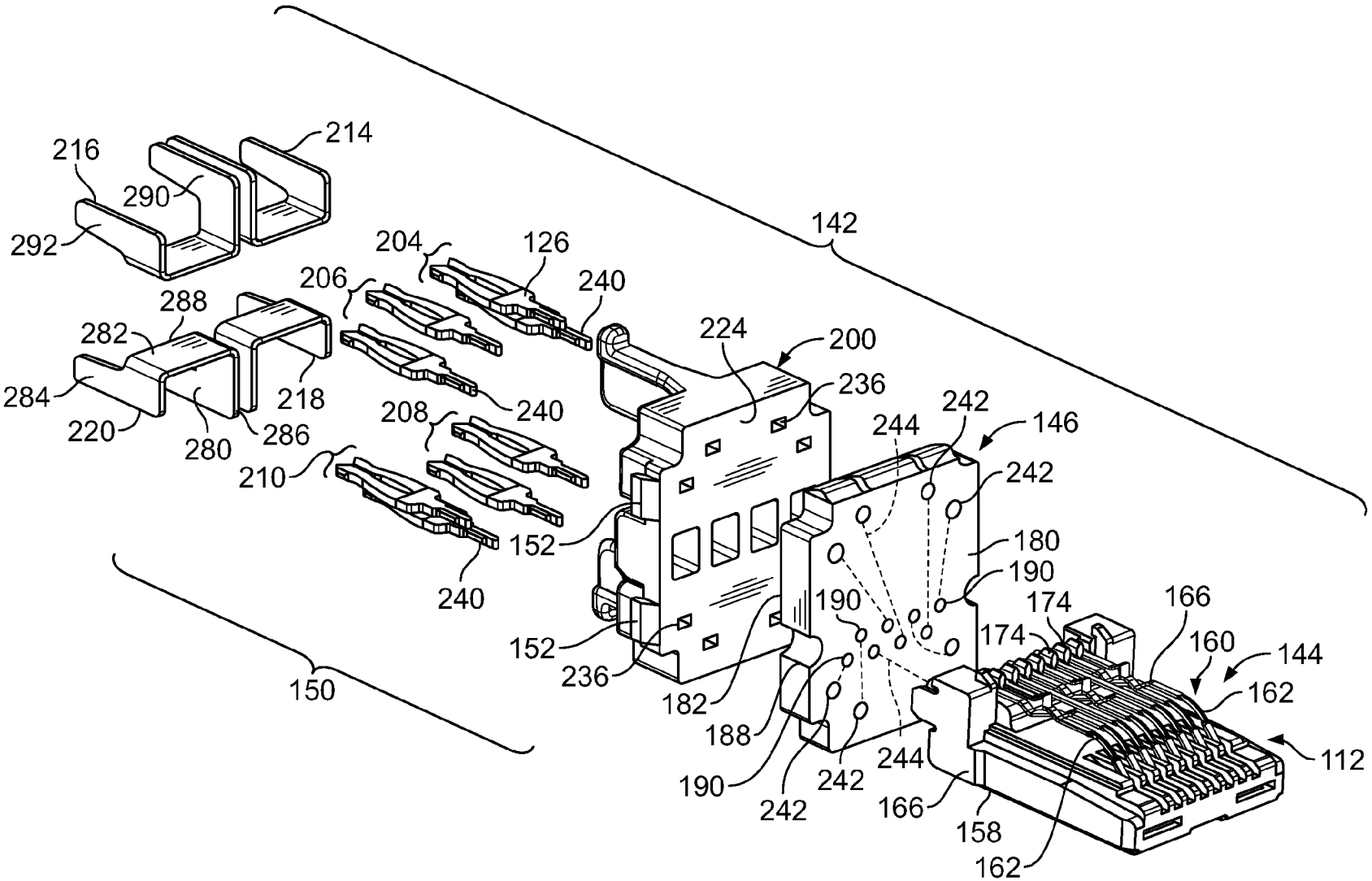
FIG. 4 is an exploded view of a connector sub-assembly for the connector shown in FIG. 1.
Figure 5:
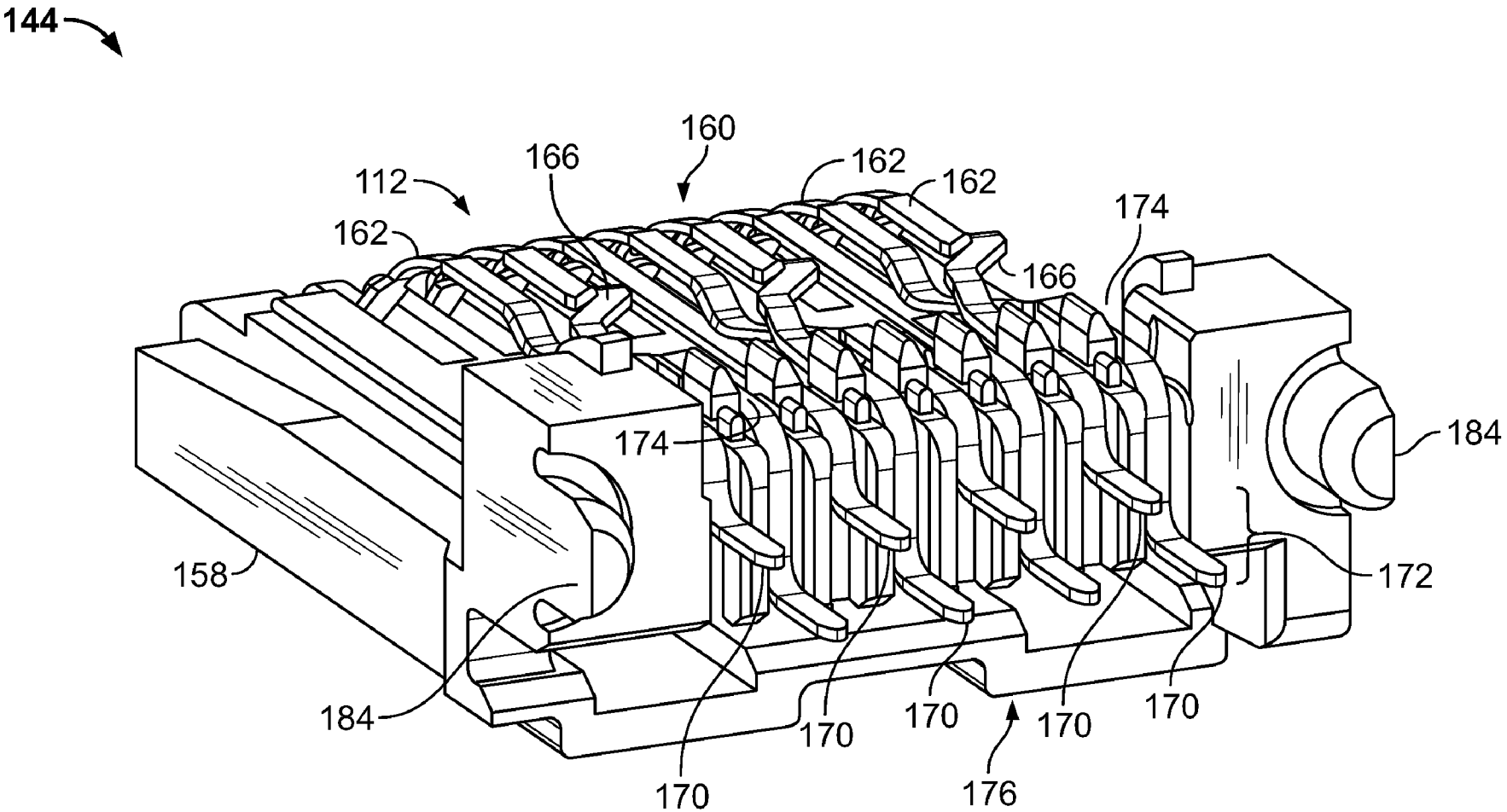
FIG. 5 is a rearward perspective view of a portion of the connector sub-assembly shown in FIG. 4.

FIG. 4 is an exploded view of the connector sub-assembly 142. FIG. 5 is a rearward perspective view of the array housing assembly 144. The array housing assembly 144 includes a dielectric base 158 that holds a contact array 160 having a row of mating contacts 162 that are positioned to engage the contacts of the mating plug (not shown). In a standard RJ-45 plug, the plug contact pairs that make up differential signal pairs are intermixed across the row of mating contacts 162. Selected ones of the mating contacts 162 are formed with crossover sections 166 that allow for mounting ends 170 of the mating contacts 162 to be rearranged into multiple rows so that the mounting ends 170 of differential pairs of the mating contacts 162 are more orderly arranged to improve crosstalk at the mating interface 112. In an exemplary embodiment, the mounting ends 170 are rearranged into two rows 172.

The base 158 includes contact channels 174 formed proximate a mounting end 176 that facilitates arranging or grouping of the mounting ends 170 of the mating contacts 162. The mounting ends 170 of the mating contacts 162 extend from the mounting end 176 of the base 158. The circuit board 146 includes a forward facing side 180 and an opposite rearward or back end side 182. The array housing assembly 144 is mounted on a forward facing side 180 of the circuit board 146 by a method known to those skilled in the art. The circuit board 146 includes a plurality of contact apertures 190 located to receive the mounting ends 170 of the mating contacts 162 to mount the mating contacts 162 on the circuit board 146. In one embodiment, the mounting ends 170 may comprise compliant mounting ends that may be received in the contact apertures 190 with a friction fit. Alternatively, other mounting means or methods ma be used, such as solder connections, to mount the mating contacts 162 on the circuit board 146.

The back end sub-assembly 150 includes a back end housing 200 that holds the back end contacts 126 which are arranged in differential pairs such as the pairs 204, 206, 208, and 210 in the illustrated embodiment. Conductive shields 214, 216, 218, and 220 are provided to isolate respective pairs 204, 206, 208, 210 of back end contacts 126. The back end housing 200 has a forward side 224 that abuts the rearward side 182 of the circuit board 146. Thus, the back end housing 200 and the array housing assembly 144 are arranged on opposite sides of the circuit board 146. Optionally, the back end housing 200 may be mechanically connected to the circuit board 146, such as by fasteners or by the contacts 126. The conductive shields 214, 216, 218, and 220 may be fabricated from a conductive material, such as metal. However, in alternative embodiments, the back end housing 200 may be formed with interior walls having surfaces to which a conductive plating is applied or to which a conductive tape is applied.

In the illustrated embodiment, the shields 214, 216, 218, and 220 are similarly formed, however, the shields 214, 216, 218, and 220 may be formed differently from one another depending on the particular application. The shields 214, 216, 218, and 220 each include a first leg 280, a second leg 282 extending from the first leg 280 and a third leg 284 extending from the second leg 282. The second leg 282 is oriented generally perpendicular with respect to the first leg 280. The third leg is oriented generally perpendicular with respect to the second leg 282. In the illustrated embodiment, the shields 214, 216, 218, and 220 form C-shaped shields, wherein the first and third legs 280, 284 both extend from the second leg 282 in the same direction. The first leg 280 is longer than the third leg 284. The shape of the shields 214, 216, 218, and 220 may be different in alternative embodiments, such as, for example, L-shaped (e.g. only the first and second legs 280, 282) or O-shaped (e.g. with the additional of a fourth leg (not shown) connecting the first and third legs 280, 284). Other shapes are possible in other embodiments.

In an exemplary embodiment, the shields 214, 216, 218, and 220 extend between a front end 286 and a rear end 288. In an exemplary embodiment, the shields 214, 216, 218, and 220 include an inner wing 290 extending rearward from the rear end 288 of the first leg 280 and an outer wing 292 extending rearward from the rear end 288 the third leg 284. Optionally, the wings 290, 292 may extend from only a portion of the legs 280, 284, respectively (e.g. have a height that is less than a height of the legs 280, 284). Alternatively, the wings 290, 292 may extend rearward from a majority of the legs 280, 284, respectively.

When assembled, the first legs 280 and/or the inner wings 290 of the first and second shields 214, 216 are positioned between adjacent back end contacts 126 of the first and second pairs 204, 206. The first legs 280 and/or the inner wings 290 of the third and fourth shields 218, 220 are positioned between adjacent back end contacts 126 of the third and fourth pairs 208, 210. When assembled, the second legs 282 of the first and third shields 214, 218 are positioned between adjacent back end contacts 126 of the first and third pairs 204, 208. The second legs 282 of the second and fourth shields 216, 220 are positioned between adjacent back end contacts 126 of the second and fourth pairs 206, 210. When assembled, the third legs 284 and/or the outer wings 292 are positioned outward from the back end contacts 126 to define a shield from electromagnetic interference or other interference from external devices, connectors and the like, such as to reduce alien crosstalk and signal degradation.

Figure 6:
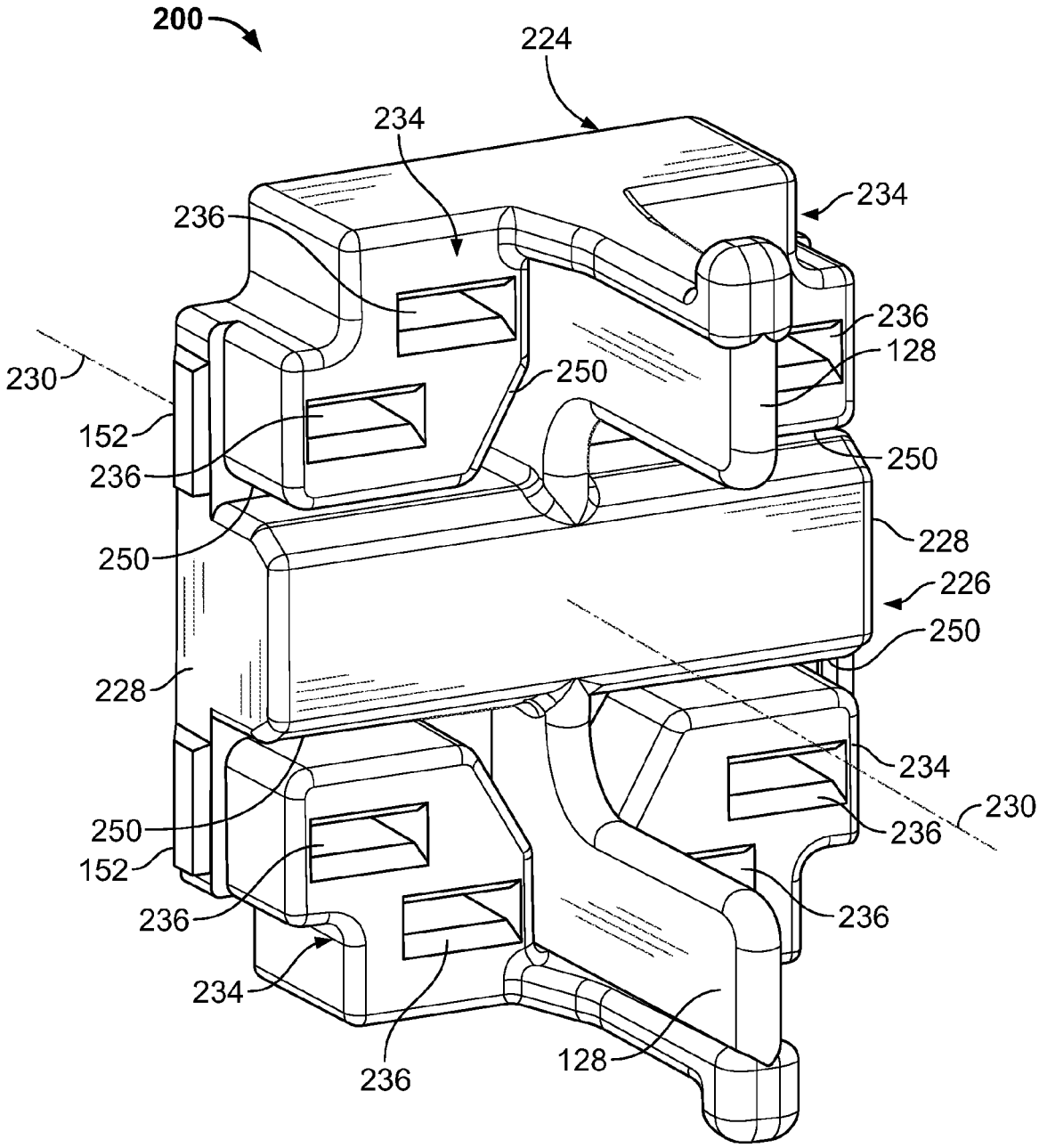
FIG. 6 is a perspective view of a back end housing of the connector sub-assembly shown in FIG. 4 and taken from a rearward side.

With continued reference to FIG. 4, FIG. 6 illustrates a perspective view of the back end housing 200 taken from a rearward or back end side 226. The back end housing 200 is fabricated from a dielectric material that extends along a longitudinal axis 230 from the forward side 224 to the rearward side 226. The axis 230 may extend along, and be coincident with, a longitudinal axis of the connector 100. The back end housing 200 includes the alignment members 128 that extend from the rearward side 226 and cooperate with the alignment slots 125 on the lacing cap 118 (FIG. 2) to align the lacing cap 118 with the back end sub-assembly 150. In the illustrated embodiment, the alignment members 128 are centered between opposite sides 228 of the back end housing 200, however other, non-centered, configurations are possible in alternative embodiments.

The rearward side 226 of the back end housing 200 includes a plurality of contact zones 234 each of which includes a pair of contact apertures 236. Each of the contact apertures 236 receives and holds a back end contact 126. The back end housing 200 may include other zones or regions that do not include any contacts, with such regions being compared to the contact zones 234 and referred to as non-contact zones. Any number of such non-contact zones may be provided. As shown in FIG. 4, the back end contacts 126 may include mounting ends 240 that are sufficient in length to extend through the back end housing 200 to be received in contact apertures 242 in the circuit board 146 to electrically connect the back end contacts 126 to the circuit board 146. In one embodiment, the mounting ends 240 of the back end contacts 126 may include compliant mounting ends such as an eye of the needle design. Alternatively, solder connections may be used to connect the back end contacts 126 to the circuit board 146. Conductive paths 244 which may be electrical traces in or on the circuit board 146 are provided to electrically connect respective pairs of the contact apertures 190 with pairs of the contact apertures 242 to thereby electrically connect respective differential pairs of back end contacts 126 with respective differential pairs of mating contacts 162.

In an exemplary embodiment, the zones 234 are distributed about the axis 230. In the case of a typical RJ-45 connector, the back end housing 200 includes four of the contact zones 234. The back end housing 200 further includes shield channels 250 arranged within the contact zones 234. The shield channels 250 receive conductive shields 214, 216, 218, 220 that substantially surround and isolate the back end contacts 126 from back end contacts 126 in other contact zones 234. Once assembled, each shield 214, 216, 218, and 220 is non-common with respect to the remaining shields 214, 216, 218, and 220. That is, each shield 214, 216, 218, and 220 is electrically independent and does not electrically engage any other shield as will be described. In the illustrated embodiment, the shield channels 250 extend inward from the rearward side 226 of the back end housing 200, however, it is to be understood that in other embodiments, the shield channels 250 may extend inward from the forward side 224 of the back end housing 200. The shape of the shield channels 250 is selected to correspond with the shape of the respective conductive shields 214, 216, 218, and 220 for receiving the shields 214, 216, 218, and 220 therein. The shields 214, 216, 218, and 220 may be held in the shield channels 250 by a friction fit, or by other means. Optionally, each shield channel 250 may be shaped substantially the same as each other shield channel 250. In the illustrated embodiment, the shield channels 250 each include a first portion, a second portion angled with respect to the first portion, and a third portion angled with respect to the second portion. The third portion may be substantially perpendicular to the first portion. Optionally, the second portion may not be included. It is to be further understood that in other embodiments, the shield channels 250 may be formed with geometric shapes other than the shapes shown in the figures herein.

Figure 7:
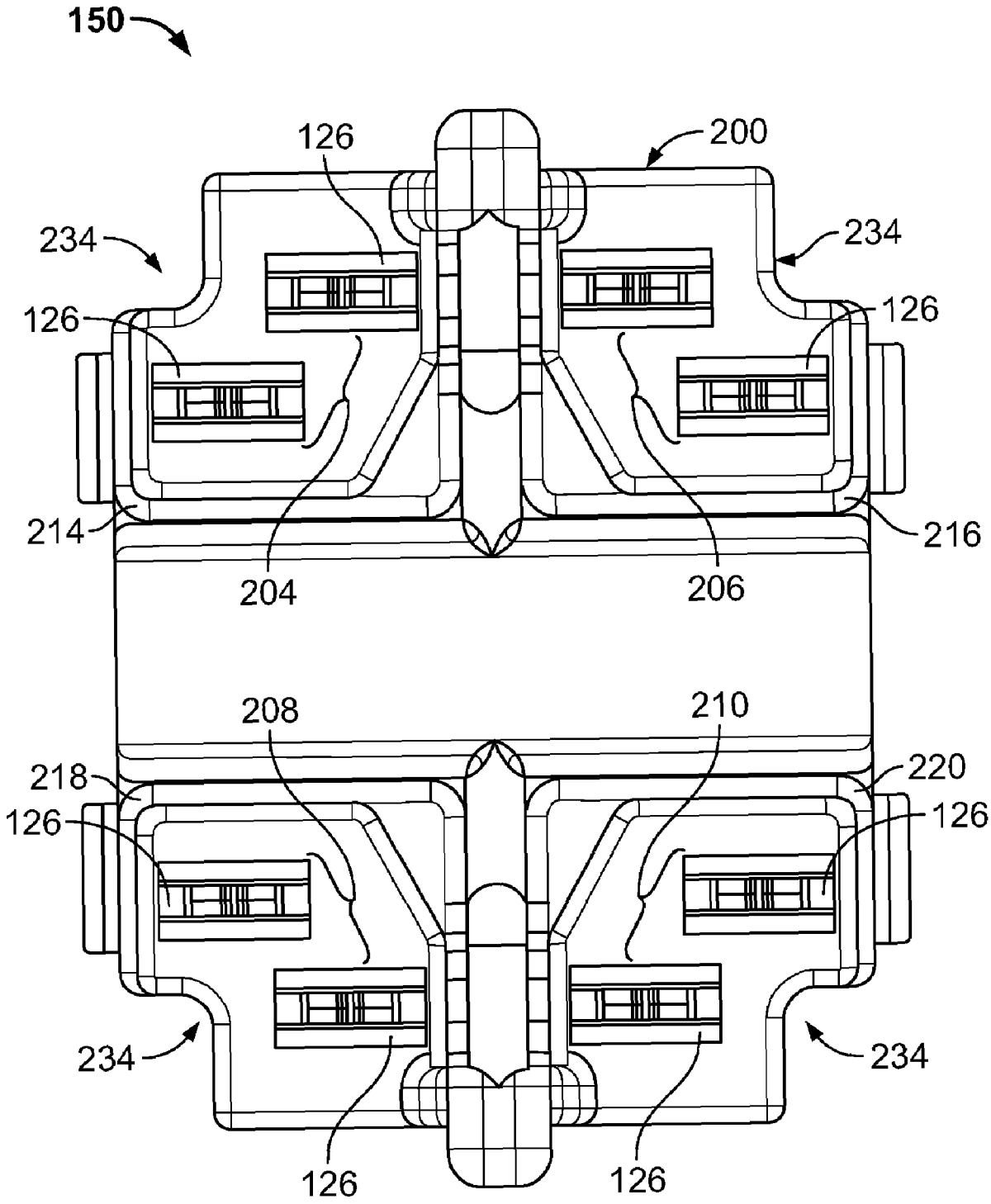
FIG. 7 is a rear elevational view of the connector sub-assembly.
Figure 8:
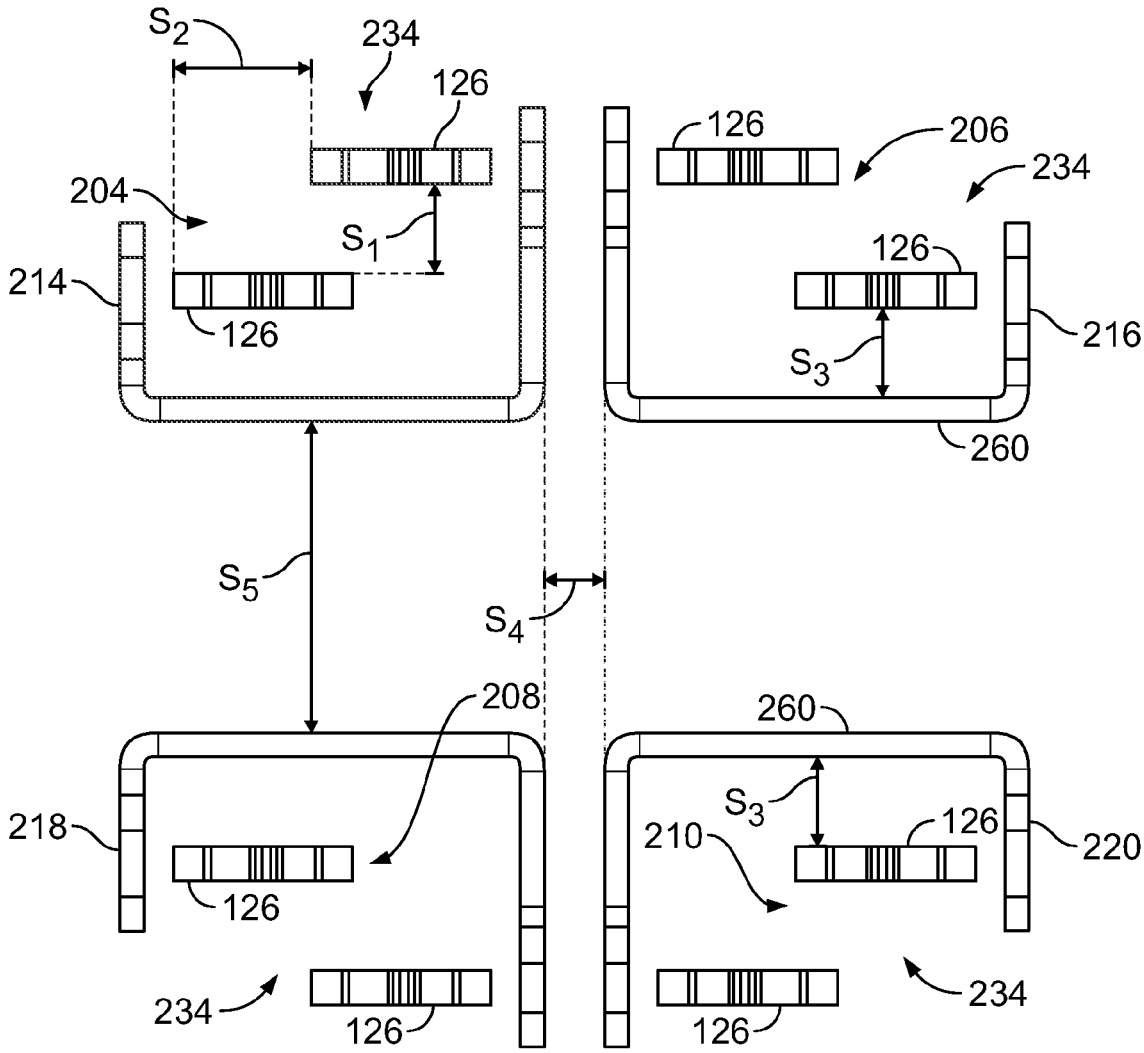
FIG. 8 illustrates back end contacts and conductive shields for use with the connector.

FIG. 7 is a rear elevational view of the back end sub-assembly 150. FIG. 8 illustrates the back end contacts 126 and conductive shields 214, 216, 218, and 220. In an exemplary embodiment, the back end contacts 126 in each contact pair 204, 206, 208, and 210 in each contact zone 234 carry differential signals. Electrical performance through the connector 100 is enhanced by locating the contact pairs 204, 206, 208, and 210 in separate sections or contact zones 234 in the back end housing 200. Optionally, the contact zones 234 may be arranged in quadrants. Each shield 214, 216, 218, and 220 substantially surrounds a respective differential contact pair 204, 206, 208, and 210, to isolate the contact pairs 204, 206, 208, 210 from crosstalk from a neighboring contact pair 204, 206, 208, 210. Further, the shields 214, 216, 218, and 220 may be arranged to provide isolation from alien crosstalk or crosstalk from a neighboring connector jack, particularly in unshielded twisted pair (UTP) applications.

In an exemplary embodiment, the shields 214, 216, 218, and 220 are floating shields. That is, none of the shields 214, 216, 218, and 220 is electrically connected to another shield 214, 216, 218, and 220 so that noise coupling between shields is minimized which enhances performance by containing the noise within a particular region in the connector 100. For example, a dielectric barrier is formed between adjacent shields 214, 216, 218, and 220, such as the back end housing 200. Alternatively, dielectric structures separate from the back end housing 200, may be coupled to the back end housing 200 between the shields 214, 216, 218, and 220. Optionally, air gaps may alternatively, or additionally, be provided between the shields 214, 216, 218, and 220 to form the dielectric barrier.

The back end contacts 126 within each pair 204, 206, 208, and 210 are spaced and positioned with respect to one another in the back end housing 200 to obtain certain design goals such as impedance and return loss in the connector 100. For example, in the illustrated embodiment, within each contact zone 234, the back end contacts 126 are separated by a distance $S_1$ and offset laterally by a distance $S_2$. The back end contacts 126 are positioned within a distance $S_3$ from a base 260 of a respective shield 214, 216, 218, and 220. Laterally aligned shields such as the shields 214 and 216 are spaced apart laterally by a distance $S_4$. Vertically aligned shields, such as the shields 214 and 218 are spaced apart vertically by a distance $S_5$. Other configurations and orientations of the back end contacts 126 and/or the shields 214, 216, 218, and 220 may be utilized in alternative embodiments.

The spacings $S_1$ through $S_5$ are selected relative to material characteristics and dimensions of the back end housing material, the contact material, and the shield material and to provide a desired impedance through the connector 100 and to facilitate minimizing signal loss. Known simulation software may be used to optimize such variables for particular design goals including connector impedance and return loss. One such simulation software is known as IFSS™ which is available from Ansoft Corporation.

Figure 9:
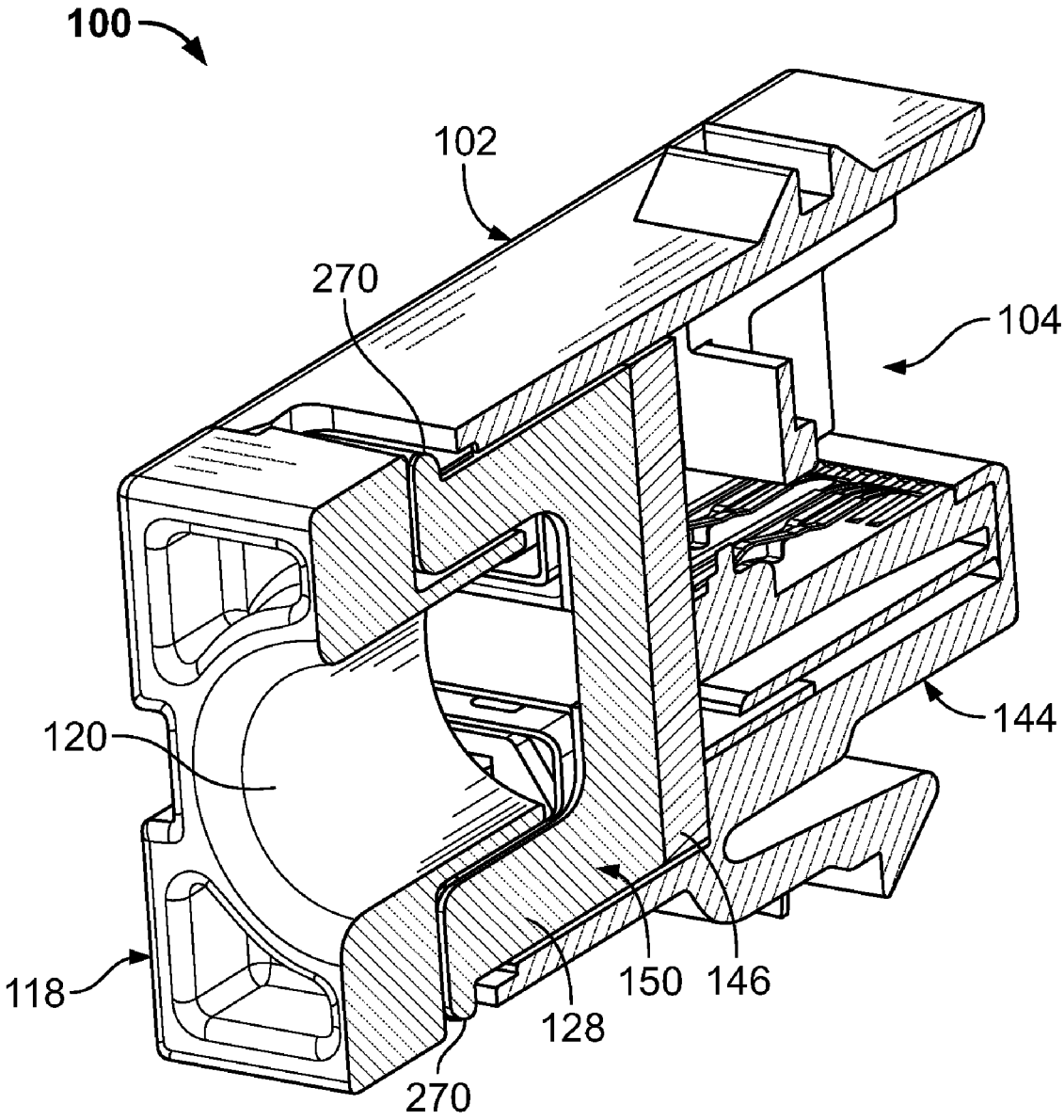
FIG. 9 is a cross-sectional view of the connector shown in FIG. 1 taken through the alignment members.
Figure 10:
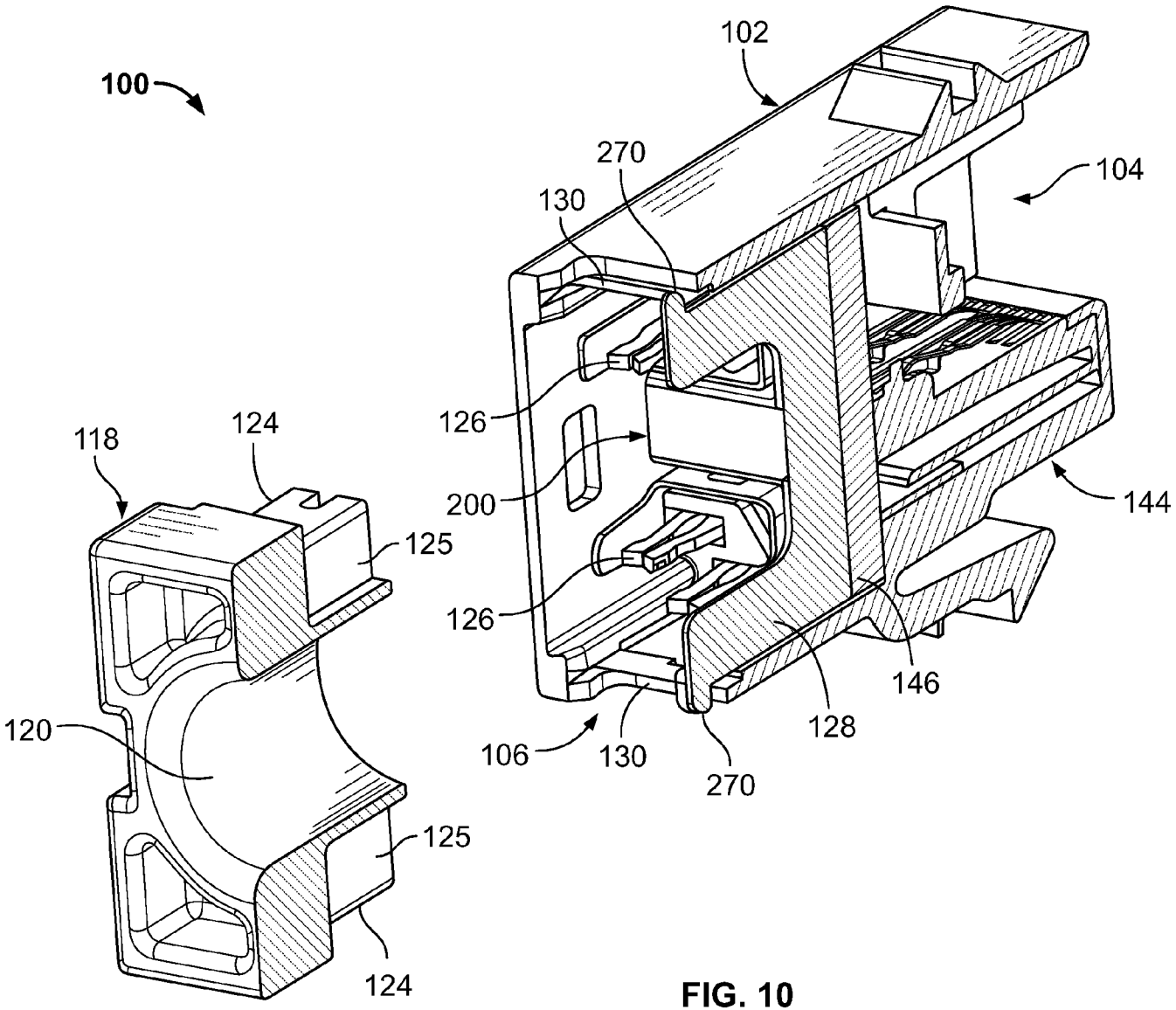
FIG. 10 is a cross-sectional view of the connector shown in FIG. 9 with a lacing cap separated from a housing.

FIG. 9 is a cross-sectional view of the connector 100 taken through the alignment members 128. FIG. 10 is a cross-sectional view of the connector 100 as shown in FIG. 9 with the lacing cap 118 separated from the connector housing 102. The lacing stations 124 formed on the lacing cap 118 constrain and align the individual cable wires (not shown) with the back end contacts 126 to facilitate termination of the wires to the back end contacts 126. As shown in FIG. 2, upper and lower pairs of the lacing stations 124 are spaced apart to form the alignment slots 125 that receive alignment members 128. The alignment members 128 are formed on the back end housing 200 which also holds the back end contacts 126. Thus, in the connector 100, the housing 102 is not relied on for alignment of the lacing stations 124 with the back end contacts 126. That is, any flexing that may occur in any of the side walls of the housing 102 during assembly does not produce misalignment between the lacing stations 124 and the back end contacts 126. Further, in the design of the connector 100, the removal of the housing 102 from the alignment process minimizes the tolerance stack during assembly of the connector 100.

As previously described, the alignment members 128 are centrally positioned between the sides 228 of the back end housing 200 (see FIG. 6). The alignment provided by the alignment members 128 may facilitate the prevention of interference between the lacing stations 124 and the conductive shields 214, 216, 218, 220 (FIG. 8) during assembly of the connector 100. The alignment members 128 also provide dielectric material between the conductive shields 214 and 216 and between the conductive shields 218 and 220. The alignment members 128 may thus provide further isolation of the pairs from one another, which may improve the electrical performance of the connector 100. In one embodiment, the alignment members 128 also are formed with projections 270 that are configured to engage and hold the cutting blades 130 in position in the housing 102 for assembly of the lacing cap 118 to the housing 102.

The embodiments thus described provide an enhanced connector 100 that is compatible with standard RJ-45 applications and facilitates improving performance with an improved back end design. Shields 214, 216, 218, and 220 separate and isolate respective pairs (204, 206, 208, and 210) of back end contacts 126. The shields do not electrically engage other shielding so that noise coupling between shields does not occur. The connector 100 provides enhanced transmission performance including enhanced return loss, reduced crosstalk, and reduced alien crosstalk. The connector 100 also includes an alignment system wherein alignment members 128 are formed on the back end housing 200 rather than the housing 102 so that the housing 102 is not relied on for alignment of the lacing stations 124 with the back end contacts 126 which minimizes the tolerance stack during assembly of the of the connector 100.

Figure 11:
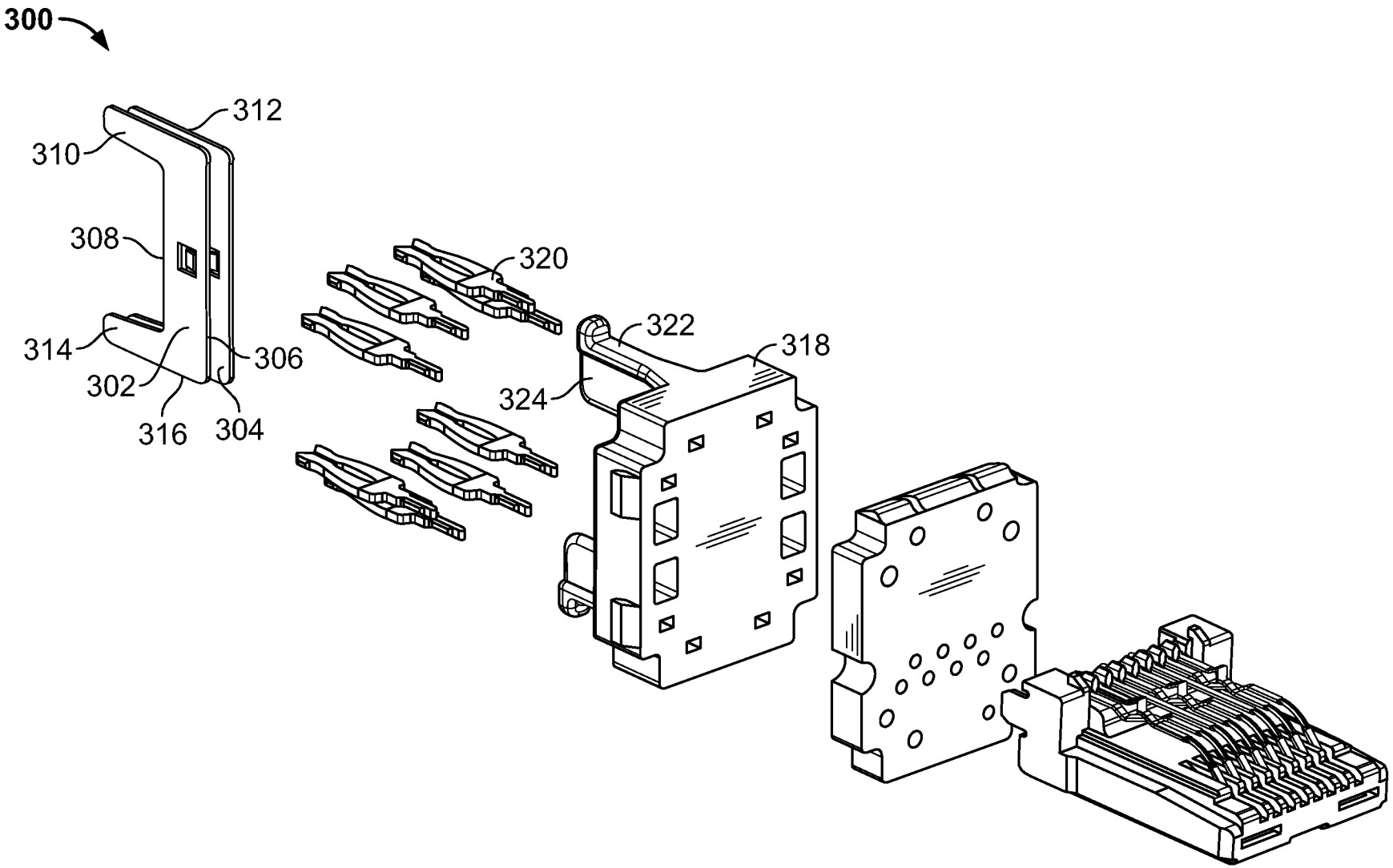
FIG. 11 is an exploded view of an alternative connector sub-assembly for the connector illustrated in FIG. 1.

FIG. 11 is an exploded view of an alternative connector sub-assembly 300 for the connector 100 (shown in FIG. 1). The connector sub-assembly 300 is similar to the connector sub-assembly 142 shown in FIG. 4. In contrast to the connector sub-assembly 142, the connector sub-assembly 300 includes two shields 302, 304. The shields 302, 304 are generally planar and extend between a front end 306 and a rear end 308. Each shield 302, 304 includes a first wing 310 extending rearward from the rear end 308 proximate a first end 312 and a second wing 314 extending rearward from the rear end 308 proximate a second end 316. The shields 302, 304 are substantially identically formed.

The connector sub-assembly 300 includes a back end housing 318 used to house a plurality of back end contacts 320. The back end housing 318 includes alignment members 322 at the rear of the back end housing 318. When assembled, the shields 302, 304 are positioned on opposed sides 324 of the alignment members 322. The shields 302, 304 are utilized to isolate different ones of back end contacts 320.

Figure 12:
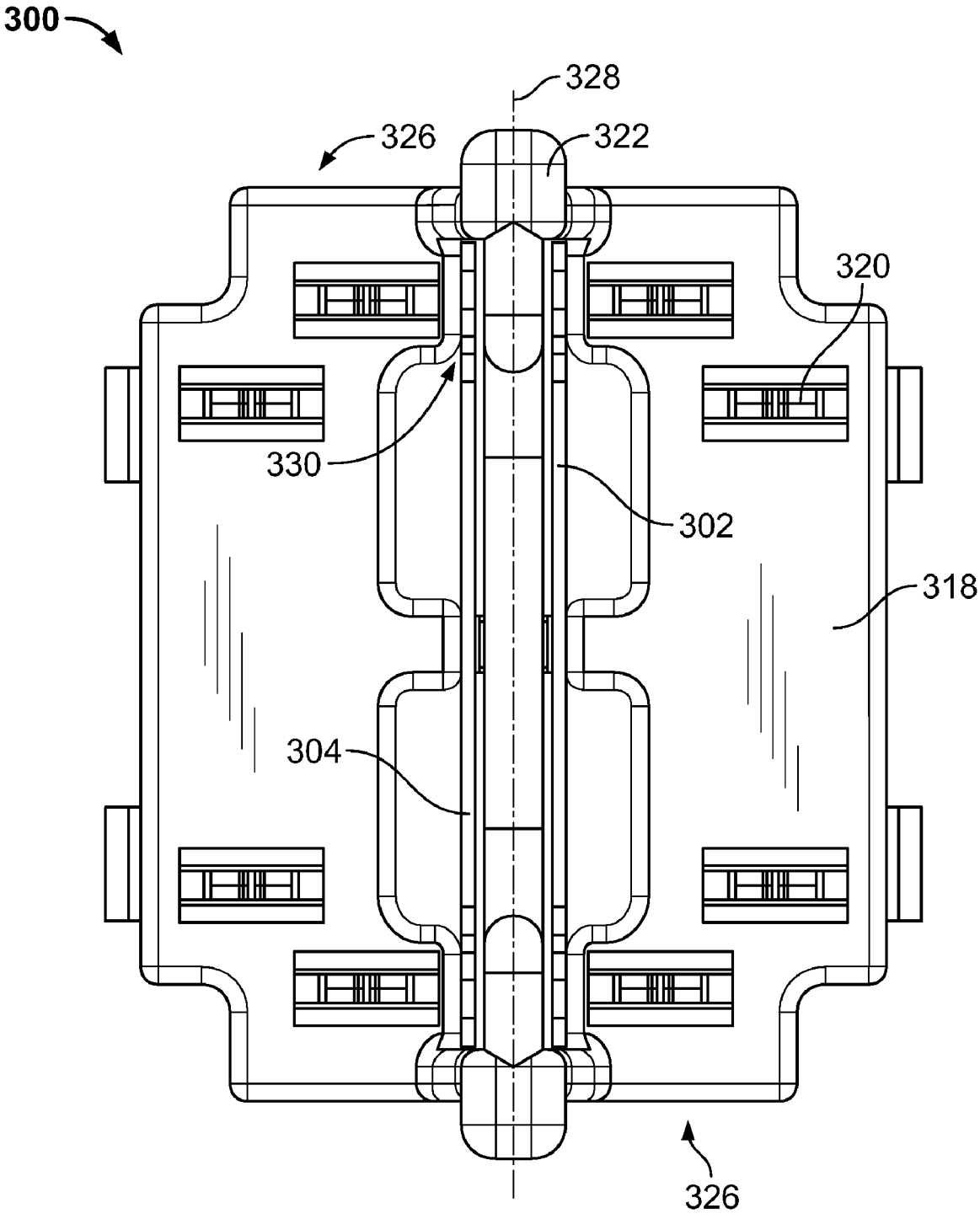
FIG. 12 is a rear elevational view of the connector sub-assembly shown in FIG. 11.

FIG. 12 is a rear elevational view of the connector sub-assembly 300 illustrating the back end housing 318 and back end contacts 320. In an exemplary embodiment, the connector sub-assembly 300 defines two contact zones 326 which are arranged on opposite sides of a central axis 328 of the connector sub-assembly 300. Optionally, the alignment members 322 are arranged along the central axis 328. Each contact zone 326 includes two pairs of back end contacts 320. The first shield 302 is provided within a first of the contact zones 326 and the second shield 304 is provided within a second of the contact zones 326. In an exemplary embodiment, shield channels 330 are provided in the back end housing 318. The shields 302, 304 are received in the shield channels 330. The shields 302, 304 are utilized to isolate different ones of back end contacts 320. In an exemplary embodiment, the shield channels 330 are provided adjacent the alignment members 322.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. More-over, the terms "first," "second," and "third," etc. in the claims are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

While the invention has been described in terms of various specific embodiments, those skilled in the art will recognize that the invention can be practiced with modification within the spirit and scope of the claims.

What is claimed is:

1. An electrical connector comprising:

a back end sub-assembly including a back end housing extending along a longitudinal axis between a forward side and a rearward side, the back end housing defining a plurality of contact zones arranged in quadrants;

at least one contact held in each of the quadrants of the plurality of contact zones; and an electrical shield provided within each of the plurality of contact zones, each shield at least partially surrounding the at least one contact in the corresponding contact zone, wherein each shield is non-common with and does not electrically engage any other shield in the back end housing.

2. The electrical connector of claim 1, wherein each contact zone includes a single pair of contacts carrying differential signals.

3. The electrical connector of claim 1, wherein each shield is arranged at least partially between the associated contact zone and at least two other contact zones.

4. The electrical connector of claim 1, wherein each contact zone includes more than two contacts.

5. The electrical connector of claim 1, wherein each quadrant contains a single contact zone, each shield being arranged between at least two adjacent quadrants.

6. The electrical connector of claim 1, wherein each contact zone is separated from each other contact zone by at least two shields.

7. The electrical connector of claim 1, wherein each shield is separated from each other shield by a dielectric barrier.

8. The electrical connector of claim 1, wherein the back end housing includes a plurality of shield channels, each shield being received in a corresponding shield channel.

9. The electrical connector of claim 1, wherein each shield is securely held by the back end housing.

10. The electrical connector of claim 1, wherein the contacts extend along a contact axis, the contacts are arranged in the corresponding contact zone such that the contact axes of contacts in adjacent contact zones are aligned in a contact plane, wherein at least one shield extends along and within the contact plane.

11. The electrical connector of claim 10, wherein each shield includes a wing extending outward therefrom, the wing extending along and within the contact plane.

12. The electrical connector of claim 1, wherein each shield extends proximate to an external side of the back end housing to provide shielding for at least one of the contacts from alien cross-talk.

13. An electrical connector comprising:

a housing having a forward mating end and an opposite rearward cable receiving end;

a connector assembly having an array of mating contacts arranged within the housing at the forward mating end for mating engagement with a mating connector;

a back end sub-assembly held in the housing proximate the cable receiving end, the back end sub-assembly including a back end housing extending along a longitudinal axis between a forward side and a rearward side, the back end housing being configured to receive individual wires of a multi-wire cable through the rearward side, the back end housing defining a plurality of contact zones;

a pair of back end contacts held in each contact zone, the back end contacts being discrete from the mating contacts and being electrically connected to corresponding mating contacts of the connector assembly, each of the back end contacts being electrically connected to corresponding wires of the multi-wire cable; and a conductive shield held in each contact zone, the shield positioned between the contacts in the corresponding contact zone and at least one contact in at least one other contact zone, wherein each shield is a floating shield that does not electrically engage any other shield in the back end housing.

14. The electrical connector of claim 13, wherein the back end housing is arranged in quadrants, each quadrant containing a single contact zone, each shield being arranged between at least two adjacent quadrants.

15. The electrical connector of claim 13, wherein each shield is separated from each other shield by a dielectric barrier.

16. The electrical connector of claim 13, wherein the back end housing includes a plurality of shield channels, each shield being received in a corresponding shield channel.

17. An electrical connector comprising:

a housing having a forward mating end and an opposite rearward cable receiving end;

a back end sub-assembly held in the housing proximate the cable receiving end, the back end sub-assembly including a back end housing holding back end contacts and a conductive shield positioned between selected ones of the back end contacts, the back end housing extending along a longitudinal axis between a forward side and a rearward side, the back end housing including an alignment member extending toward the cable receiving end of the housing; and a lacing cap attached to the cable receiving end of the housing, the lacing cap configured to receive a multi-wire cable and including lacing stations configured for holding the individual wires of the multi-wire cable to terminate to the back end contacts, the lacing cap including an alignment slot that receives the alignment member to align the lacing stations with the back end contacts.

18. The electrical connector of claim 17, wherein the alignment member is centrally positioned between opposite sides of the back end housing.

19. The electrical connector of claim 17, wherein the back end housing defines a plurality of contact zones and the alignment member is positioned between an adjacent pair of contact zones.

20. The electrical connector of claim 17, wherein the alignment slot is formed between adjacent lacing stations.

* * * * *